United States Patent [19]

Melys

[11] 4,395,081

[45] Jul. 26, 1983

[54] ELECTRICAL CONNECTOR

[75] Inventor: Aleksandras A. Melys, Hillside, N.J.

[73] Assignee: Sweda International, Inc., Pine Brook, N.J.

[21] Appl. No.: 251,426

[22] Filed: Apr. 6, 1981

[51] Int. Cl.[3] ..... H01R 4/66

[52] U.S. Cl. ..... 339/14 R; 339/256 SP; 339/276 F

[58] Field of Search ..... 339/14 R, 256 SP, 258 S, 339/276 F, 143 R

[56] References Cited

U.S. PATENT DOCUMENTS 3,533,048 10/1970 Teagno et al. ..... 339/256 SP
4,068,914 1/1978 Mach ..... 339/143 R

FOREIGN PATENT DOCUMENTS 2296282 7/1976 France ..... 339/256 SP
799370 8/1958 United Kingdom ..... 339/258 S

*Primary Examiner*—Eugene F. Desmond
*Attorney, Agent, or Firm*—Robert F. Rotella; Michael H. Wallach

[57] ABSTRACT

An electrical connector is shown including a sheet metal contact having longitudinal edges which are rolled to form two partially opened cylinders that engage tines formed within a conductive ground plane by cutting recesses into the plane to expose the tines. The tines are designed to present sharp edges to the inner surface of the partially open spring cylinders for assuring high electrical conductivity between the contact and the ground plane.

8 Claims, 15 Drawing Figures

ELECTRICAL CONNECTOR

The present invention relates to an electrical connector and, more particularly, to an integral sheet metal contact which electrically connects a conductive wire to an integral tine on a ground plane.

BACKGROUND OF THE INVENTION

In the 1950's, the wiring of electrical components within an electrical system was vastly simplified by the introduction of printed circuit boards. These boards generally utilized a nonconductive base, such as phenolic, upon which conductive ribbons or strips, such as copper, could be placed for making electrical connections between plated through holes in which the leads of the electrical components were inserted and electrically connected by solder. Since that time, many improvements have been made in the methods of manufacturing printed circuit boards and the techniques for joining electrical components thereto.

As this development continued, the electrical connector art also improved. Screw machine contacts that had to be soldered on to electrically conductive wires were replaced with stamped sheet metal contacts which could be crimped on to a conductive wire after the insulation thereon had been stripped from the end thereof. These sheet metal contacts were often designed for insertion into insulated electrical connectors which were then connected to the printed circuit boards. In some applications, however, it became possible to connect conductive wire directly to the component without the need for a separate electrical connector. Thus, the integral contact itself became the electrical connector system.

Examples of integral electrical contacts which are used to connect a conductive wire directly to the conductive strip upon a printed circuit board may be found in U.S. Pat. No. 2,980,878 by R. C. Swengel and U.S. Pat. No. 3,079,578 also by R. C. Swengel. Each of the Swengel patents discloses a contact having a pair of J-shaped edges wherein the outermost tip of the shorter leg of the J frictionally engages the conductive ribbon upon the printed circuit board. The contacts described within the Swengel patents work well for low voltage signals such as those generally encountered on the conductive strips of a printed circuit board. However, over a period of time the single edge contact begins to corrode due to atmospheric contamination thus increasing the resistance between the contact and the conductive ribbon.

Another example of a specially designed integral sheet metal contact which acts as an electrical connector system for connecting a conductive wire to the chassis of an electrical housing is shown in U.S. Pat. No. 3,535,673 by F. J. Maltais and W. W. Loose. Other variations of this ground terminal are shown in U.S. Pat. No. 3,686,609 by W. A. Hansen and U.S. Pat. No. 3,910,663 by J. L. Winger. Each of these ground terminals utilize serrated edges to ensure good electrical contact between the terminal and the housing in which it is inserted. Clearly, removal and insertion of the ground terminal over a period of time will cause wear of the serrated edges and deteriorate the electrical connection between the terminal and the housing in which the terminal is inserted.

As the techniques for mounting electricl components upon printed circuit boards has improved, the components have been mounted closer together thus increasing the problem of electrical interference and the need for a good ground connection. Many electrical packaging systems have thus begun to incorporate ground planes which are large sheets of conductive material, such as aluminum. These ground planes may be interspersed among the printed circuit boards to provide good electrical grounding.

Over the life of an electrical system in which a ground plane is used, connection with that ground plane may be made and broken many times. Thus, an electrical connector system associated with a typical ground plane must be highly reliable, have a long life, and introduce a minimum amount of electrical resistance between the ground plane and the conductive element connected thereto.

SUMMARY OF THE INVENTION

Accordingly, it is an object of the present invention to provide an improved electrical connector system.

It is another object of the present invention to provide an improved connector system which may be utilized to connect a conductive wire to a ground plane and which requires a minimum amount of space, provides a simple method of engagement and disengagement, introduces a minimum amount of electrical resistance between the conductive wire and the ground plane, and has an extended life.

In accomplishing the foregoing objects there is provided a sheet metal contact which may be crimped upon a conductive wire having a ground plane connector portion. The ground plane connector portion includes a flat plate extending along the longitudinal axis of the sheet metal contact having outer edge areas which may be rolled to form partially opened spring cylinders.

The spring cylinders engage tines formed within the edge of a ground plane by recesses which extend from the outer edge of the plane toward the inner surface thereof. The tines thus formed, are provided with sharp conductive edges which engage the inner surface of the spring cylinders for ensuring good electrical conductivity between the ground plane and the sheet metal contact.

DESCRIPTION OF THE DRAWINGS

For a better understanding of the invention summarized above and of the objects and advantages presented thereby, the reader's attention is directed to the following specification and accompanying drawings, wherein.

DESCRIPTION OF THE PREFERRED EMBODIMENTS

Figure 1:
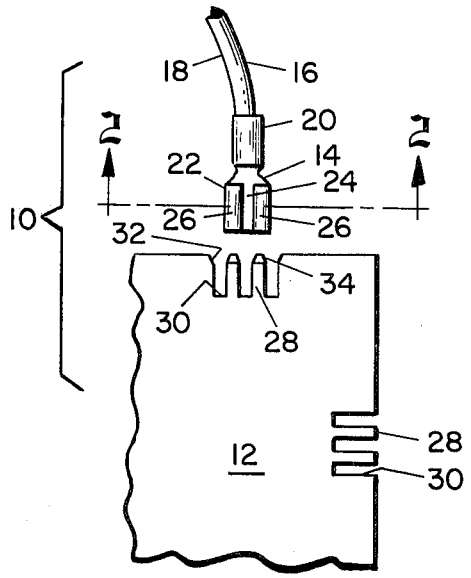
FIG. 1 is a side elevational view showing the electrical connector system of the present invention.

Referring now to the drawings, FIG. 1 shows an electrical ground plane connector system 10 including a ground plane 12 which may be constructed from steel or hard aluminum or other suitable conductive material. Mounted upon the ground plane 12 are electrical components or electrical connectors, not shown, which may be attached electrically to the ground plane to provide a good grounding connection. Connection to the ground plane 12 is accomplished by a sheet metal contact 14 which is crimped upon a conductive wire 16.

The wire 16 may be covered with an insulation 18, as is well known, which has been stripped from the end of the wire to expose the conductive portion thereof. The sheet metal contact 14 is provided with a ferrule portion 20 which is also referred to as an open barrel crimp portion. The ferrule portion consists of a U-shaped member, prior to crimping, having two sets of legs which extend outwardly to receive the wire 16 and its insulation 18. The longer, outer set of ferrule legs are crimped about the insulation 18 while the shorter, inner set of ferrule legs are crimped about the conductive portion of wire 16. This arrangement is well known in the art.

Attached to the ferrule portion 20 of the sheet metal contact 14 is an integral ground plane connector portion 22. The ground plane connector portion 22 comprises a plate 24 which extends along the longitudinal axis of the contact 14. Each edge area of the plate 24 along the longitudinal axis is rolled to form a partially opened spring cylinder 26, the outer ends of which may have a slightly larger diameter than the inner ends for receiving tines 28.

The tines 28 may be formed within the edge of the ground plane 12 by recesses 30 cut perpendicularly to the edge of the plane. As best seen in FIG. 1, three recesses 30 will form two tines 28. In the preferred embodiment shown along the upper edge of ground plane 12 in FIG. 1, the recesses 30 are chamfered at 32 while the outer ends of the tines 28 are also chamfered on four sides to form a truncated pyramid 34. The effect of the chamfers 32 and truncated pyramids 34 on the tips of tines 28 is to provide a tapered guide channel for the contact 14 and, more particularly, for the outer ends of spring cylinders 26.

A second embodiment of the tines 28 is shown along the right-hand edge of the ground plane 12 in FIG. 1 wherein the chamfer and truncated pyramids have been eliminated. Here, it may be desired to taper the outermost ends of the open spring cylinders 26 so that the other opening is larger than the remaining portion of the cylinder. This will permit easy access of the spring cylinders 26 over tines, 28.

Figure 2:
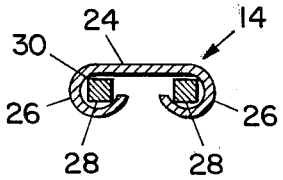
FIG. 2 is a cross-sectional view taken along line 2—2 of FIG. 1 after the connector system has been assembled.

As seen in FIG. 2, the tines 28 are cut with sharp edges 30 which frictionally engage the inner surfaces of the partially opened spring cylinders 26. In FIG. 2, it will be noted that each tine 28 engages the inner surface at three locations. Through this arrangement, there is an assured electrical contact between a substantial portion of each tine 28 and the contact 14 which will prevent an increased resistance between tine 28 and contact 14 due to the build up of corrosion therebetween caused by contaminated atmospheric conditions.

Figure 3:
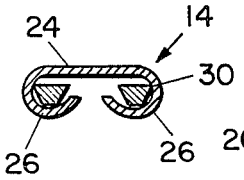
FIG. 3 is a cross-sectional view similar to FIG. 2 showing a second embodiment of the present invention.
Figure 4:
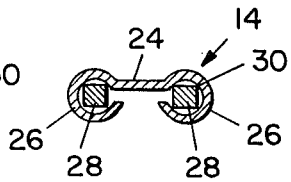
FIG. 4 is a cross sectional view similar to FIG. 2 showing yet another embodiment of the present invention.

As seen in FIG. 3, the tines 28 may be varied to form a trapezoidal cross section. The advantage of such a cross section is that it may be more easily inserted into the partially opened spring cylinders 26 while each tine 28 is still capable of contacting each cylinder 26 in three places. Should a four edge contact of each tine 28 be desired, it is possible to modify the ground plane connector portion 22 by first rolling the outer edge of the extending plate 24 to form a more circular cylinder which permits each of the four edges of the tine 28 to engage an inner surface of the cylinder 26. See FIG. 4.

Figure 5A:
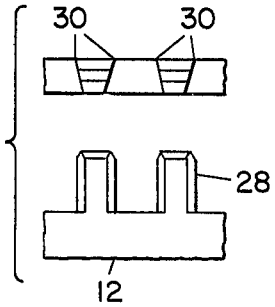
FIGS. 5*a* through *k* are top and side views of variations of the tines which may be formed within the ground plane.
Figure 5B:
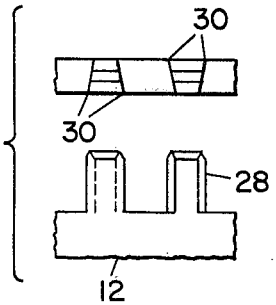
Figure 5C:
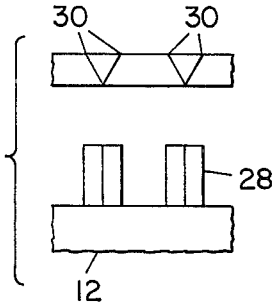
Figure 5D:
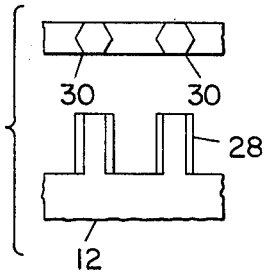

Referring now to FIG. 5, FIGS. 5*a–d* represent variations of the tines 28 discussed above. For example FIG. 5*a* shows the tines of FIG. 3 with truncated upper ends. FIG. 5*b* shows tines similar to FIG. 5*a* except that one tine is rotated 180° with respect to the other. FIG. 5*c* shows triangular tines 28; while FIG. 5*d* shows hexagonally shaped tines. Each of the tines 28 shown in FIGS. 5*a* through 5*d* present a plurality of sharp edges 30 to the partially opened spring cylinders 26 within contact 14 for assuring good electrical connection between the tines 28 and the contact 14.

Figure 5E:
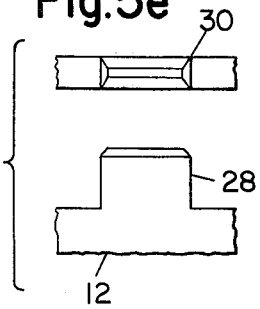
Figure 5F:
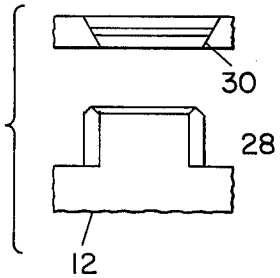
Figure 5G:
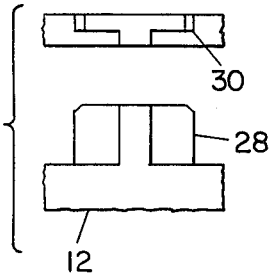
Figure 5H:
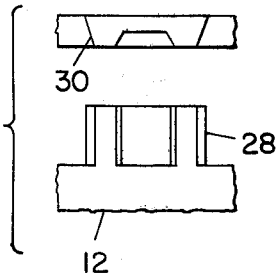
Figure 5I:
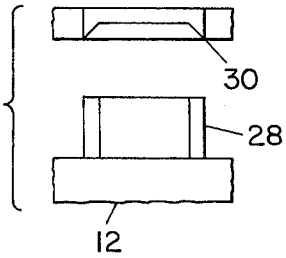
Figure 5J:
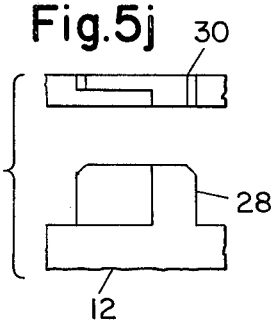
Figure 5K:
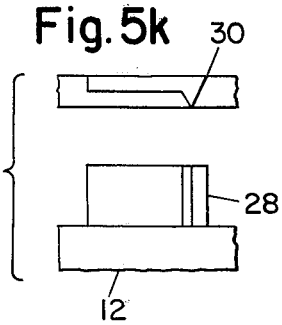

FIGS. 5*e–k* show variations of the tines 28 which may be formed in the ground plane 12 by cutting but two recesses 30 into the side edges of the plane. The single tine 28 shown in FIG. 5*e* is chamferred around its upper edges to permit easy reception within the partially opened spring cylinders 26 of contact 14. Similarly, the variations shown in FIGS. 5*f* through 5*k* present a single tine 28 which may be easily inserted in the partially opened spring cylinders 26. Each tine 28 within FIGS. 5*f–k* has been modified to present sharp edges 30 to the partially opened spring cylinders of contact 14.

While the preferred embodiments includes two tines 28, the advantage of utilizing a single tine in the present invention is that the ground plane 12 may be simply modified to produce an integral tine 28 which conveniently receives the contact 14. The single tine 28 is thus formed upon the ground plane rather than formed separately and attached thereto by bolts, solder or other convenient means. The arrangement shown by the present invention permits a tine or tines 28 to be economically formed in a ground plane to which contact 14 to be firmly connected both mechanically and electrically. The arrangement also utilizes a minimum amount of space permitting the electrical connector of the present invention to fit within the same space and plane as the ground plane 12.

While an electricl ground plane connector system has been shown with several variations of both the contact 14 and tines 28, it will be understood that the invention should be limited only by the appended claims.

I claim:

1. An electrical ground plane connector system, comprising:

an integral sheet metal contact having an open barrel crimp portion which crimps about a conductive wire and a ground plane connector portion; and a ground plane of a conductive material having a plurality of slots cut into an edge thereof to form at least a pair of tines each tine having a plurality of longitudinally extending sharp conductive edges;

said ground plane connector having rolled longitudinal sides which form partially open spring cylinders for receiving said tines, wherein said sharp conductive edges frictionally engage said spring cylinders;

each of said spring cylinders being adapted to be in contact engagement with at least three of said plurality of conductive edges of its respective tine; whereby the degree of electrical contact between said ground plane and contact is improved.

2. An electrical ground plane connector system, as claimed in claim 1, wherein:

each outer end of said plurality of tines is formed with a truncated pyramid to guide said spring cylinders into conductive engagement with said tines.

3. An electrical ground plane connector system, as claimed in claim 1, wherein:

said tines have a square cross section.

4. An electrical ground plane connector system, as claimed in claim 1, wherein:

said one or more tines have a trapezoidal cross section.

5. An electrical ground plane connector system, as claimed in claim 1, wherein:

said one or more tines have a triangular cross section.

6. An electrical ground plane connector system, as claimed in claim 1, wherein:

said one or more tines have a hexagonal cross section.

7. An electrical ground plane connector system, as claimed in claim 1, wherein:

said one or more tines are formed from a single member configured with a plurality of sharp conductive edges.

8. An integral sheet metal contact having a wire crimp portion and a ground plane connector portion wherein said ground plane connector portion comprises:

a flat conductive plate extending along the longitudinal axis of said contact having outer longitudinal edge areas, each edge area of said plate rolled about an axis parallel to said longitudinal axis of said contact to form two partially open spring cylinders, and said partially open spring cylinder each having an outermost end opening slightly large in diameter than the diameter of the remainder of said cylinder to receive a pair of tine-like elements extending from a ground plane;

said tines being provided with a plurality of longitudinally extending sharp conductive edges, each of said tines being adapted to receive a respective one of said spring cylinders;

each of said spring cylinders being in contact engagement with at least three of said plurality of conductive edges of its respective tine when said tine is in receiving relationship with its respective spring cylinder, whereby the degree of electrical contact between said ground plane and contact is augmented.

* * * * *

UNITED STATES PATENT AND TRADEMARK OFFICE

CERTIFICATE OF CORRECTION

PATENT NO. : 4,395,081

DATED : July 26, 1983

INVENTOR(S) : Aleksandras A. Melys

It is certified that error appears in the above—identified patent and that said Letters Patent is hereby corrected as shown below:

Column 5, line 9, delete "one or more"

Column 5, line 13, delete "one or more"

Column 5, line 16, delete "one or more"

Column 5, line 19, delete "one or more"

Signed and Sealed this

*Eleventh* Day of *October 1983*

[SEAL]

*Attest:*

GERALD J. MOSSINGHOFF

*Attesting Officer*

*Commissioner of Patents and Trademarks*